US010366809B2

(12) United States Patent
Fukuda et al.

(10) Patent No.: US 10,366,809 B2
(45) Date of Patent: Jul. 30, 2019

(54) INSULATED WIRE, COIL, AND ELECTRIC OR ELECTRONIC EQUIPMENT

(71) Applicants: FURUKAWA ELECTRIC CO., LTD., Tokyo (JP); FURUKAWA MAGNET WIRE CO., LTD., Tokyo (JP)

(72) Inventors: Hideo Fukuda, Tokyo (JP); Isao Tomomatsu, Tokyo (JP); Makoto Oya, Tokyo (JP); Daisuke Muto, Tokyo (JP)

(73) Assignees: FURUKAWA ELECTRIC CO., LTD., Tokyo (JP); FURUKAWA MAGNET WIRE CO., LTD., Tokyo (JP)

( * ) Notice: Subject to any disclaimer, the term of this patent is extended or adjusted under 35 U.S.C. 154(b) by 0 days.

(21) Appl. No.: 16/250,501

(22) Filed: Jan. 17, 2019

(65) Prior Publication Data

US 2019/0156970 A1 May 23, 2019

Related U.S. Application Data

(63) Continuation of application No. PCT/JP2017/025993, filed on Jul. 18, 2017.

(30) Foreign Application Priority Data

Jul. 19, 2016 (JP) ..... 2016-141817

(51) Int. Cl.
*H01B 7/02* (2006.01)
*H01B 3/30* (2006.01)
(Continued)

(52) U.S. Cl.
CPC ..... *H01B 7/0216* (2013.01); *H01B 3/301* (2013.01); *H01B 3/305* (2013.01); *H01B 3/306* (2013.01);
(Continued)

(58) Field of Classification Search
CPC ..... H01B 3/301; H01B 3/305; H01B 3/306; H01B 3/441; H01B 3/141; H01B 7/0216; H01F 5/06; H01F 41/12
See application file for complete search history.

(56) References Cited

U.S. PATENT DOCUMENTS

2013/0037304 A1* 2/2013 Ikeda ..... H01B 3/306 174/119 C
2016/0322126 A1* 11/2016 Oya ..... H01F 5/06

FOREIGN PATENT DOCUMENTS

WO WO 2015/098640 A1 7/2015
WO WO 2015/105095 A1 7/2015
WO WO 2016/103804 A1 6/2016

OTHER PUBLICATIONS

International Search Report (PCT/ISA/210) issued in PCT/JP2017/025993, dated Sep. 12, 2017.
(Continued)

*Primary Examiner* — Hoa C Nguyen
*Assistant Examiner* — Amol H Patel
(74) *Attorney, Agent, or Firm* — Birch, Stewart, Kolasch & Birch, LLP

(57) ABSTRACT

An insulated wire having a thermosetting resin layer on the outer periphery of a conductor and a thermoplastic resin layer on the outer periphery of the thermosetting resin layer, wherein a total thickness of the thermosetting resin layer and the thermoplastic resin layer is 100 μm or more and 250 μm or less, and a degree of orientation of a thermoplastic resin in said thermoplastic resin layer, that is calculated by the following Formula 1, is 20% or more and 90% or less; a coil and an electric and electronic equipment each having the insulated wire.

Formula 1 Degree of orientation H (%)=$[(360-\Sigma W_n)/360]\times 100$ $W_n$: A half width of orientation peak in the azimuth angle intensity distribution curve by X-ray diffraction
(Continued)

n: the number of orientation peak at a β angle of 0° or more and 360° or less.

6 Claims, 3 Drawing Sheets

(51) Int. Cl.
*H01F 41/12* (2006.01)
*H01B 13/14* (2006.01)
*H01B 3/44* (2006.01)
*H01F 5/06* (2006.01)

(52) U.S. Cl.
CPC ..... *H01B 3/441* (2013.01); *H01B 13/141* (2013.01); *H01F 5/06* (2013.01); *H01F 41/12* (2013.01)

(56) References Cited

OTHER PUBLICATIONS

Written Opinion of the International Searching Authority (PCT/ISA/237) issued in PCT/JP2017/025993, dated Sep. 12, 2017.

* cited by examiner

INSULATED WIRE, COIL, AND ELECTRIC OR ELECTRONIC EQUIPMENT

CROSS-REFERENCE TO RELATED APPLICATIONS

This application is a Continuation of PCT International Application No. PCT/JP2017/025993 filed on Jul. 18, 2017, which claims priority under 35 U.S.C. § 119 (a) to Japanese Patent Application No. 2016-141817 filed in Japan on Jul. 19, 2016. Each of the above applications is hereby expressly incorporated by reference, in its entirety, into the present application.

TECHNICAL FIELD

The present invention relates to an insulated wire, a coil, and electric or electronic equipment.

BACKGROUND ART

As a winding wire (magnet wire) for electric or electronic equipment (hereinafter, also referred to simply as electric equipment), an insulated electric wire (insulated wire) composed of so-called enamel wire, an insulated wire having a multilayer-structured insulating layer containing a layer composed of an enamel resin and a covering layer composed of a different kind of resin from the enamel resin, and the like have been used. Examples of the insulated wire having a two-layer structured insulating layer include those described in Patent Literature 1.

CITATION LIST

PATENT LITERATURES

Patent Literature 1: WO2015/098640

SUMMARY OF INVENTION

TECHNICAL PROBLEM

The electric equipment using a rotating electrical machine such as a motor, or a transformer and the like is inverter-controlled for its miniaturization or high efficiency.

The insulated wire used for a rotating electrical machine and the like is required to minimize deterioration caused by a partial discharge due to an inverter surge. For this, thickening of an insulating layer of the insulated wire is effective. When the insulating layer is thickened, the generated voltage of the partial discharge is increased, so that occurrence frequency of the partial discharge can be lessened.

On the other hand, in these insulated wires, the insulating layer is required to cover a conductor with high adhesion. That is, in such the electric equipment, a winding wire (coil) formed by processing (for example, by winding processing (coil processing)) an insulated wire, has come to be used in many cases, by pushing the winding wire into a very narrow portion. For example, in the above-described electric equipment, it is not an exaggeration to say that its performance depends on how many coils can be put in a slot of the stator core. Therefore, when the insulated wire is used in such electric equipment, the insulated wire is bent complicatedly with a small radius of curvature. However, for the above reason, when the insulating layer is thickened, adhesion between the conductor and the insulating layer reduces. Therefore, the insulating layer is delaminated from the conductor during or after the winding processing. In particular, delamination of the insulating layer is easy to occur in the miniaturized electric equipment.

Further in recent years, an advanced heat resistance has come to be required for insulated wires, in the miniaturized or high-performance rotating electrical machine or the like, the working voltage is set high from the view point of high efficiency, and the amount of heat generation increases accordingly. Further, in the miniaturized rotating electrical machine or the like, it is also difficult to ensure sufficient heat dissipation. Accordingly, heat resistance that can maintain a stable insulation performance, even if an insulated wire is exposed to high temperatures like 230° C. or more, has come to be demanded for insulated wires.

The present invention is contemplated to provide an insulated wire that is excellent for any of heat resistance, electric characteristics (partial discharge inception voltage), and adhesion; and a coil and electric or electronic equipment.

SOLUTION TO PROBLEM

The present inventors have found that, in an insulated wire having a thermosetting resin layer and a thermoplastic resin layer on a conductor in this order, when the total thickness of the thermosetting resin layer and the thermoplastic resin layer is set to a specific range and also a thermoplastic resin of the thermoplastic resin layer is oriented to a range of a specific degree of orientation, the insulated wire combines excellent electric characteristics and adhesion, and also shows advanced heat resistance, thereby to be able to meet the characteristics that are required for insulated wires for recent miniaturized or high-performance electric equipment. The present invention has been made on the basis of these findings.

In other words, the above-described problems of the present invention are solved by the following means.

(1) An insulated wire comprising a thermosetting resin layer on the outer periphery of a conductor, and a thermoplastic resin layer on the outer periphery of the thermosetting resin layer, wherein a total thickness of the thermosetting resin layer and the thermoplastic resin layer is 100 μm or more and 250 μm or less, and a degree of orientation of a thermoplastic resin in the thermoplastic resin layer, that is calculated by the following Formula 1, is 20% or more and 90% or less.

Formula 1 Degree of orientation H (%)=$[(360-\Sigma W_n)/360]\times 100$ $W_n$: A half width of orientation peak in the azimuth angle intensity distribution curve by X-ray diffraction n: the number of orientation peak at a β angle of 0° or more and 360° or less.

(2) The insulated wire described in the item (1), wherein the thermoplastic resin layer has at least one thermoplastic resin selected from the group consisting of a polyetheretherketone, a thermoplastic polyimide, and a polyphenylene sulfide, and a melting point of the thermoplastic resin is 260° C. or more and 390° C. or less.

(3) The insulated wire described in the item (1) or (2), wherein a thickness of the thermoplastic resin layer is 15 μm or more and 100 μm or less.

(4) The insulated wire described in any one of the items (1) to (3), wherein the thermosetting resin layer comprises at least one thermosetting resin selected from the group consisting of a polyamideimide, a polyimide, and a polyesterimide.

(5) A coil having the insulated wire described in any one of the items (1) to (4).

(6) Electric or electronic equipment formed with using the coil described in the item (5).

In the present invention, the thermosetting resin layer means a thermosetting resin layer formed of a cured thermosetting resin, and can be formed by curing an uncured thermosetting resin.

EFFECTS OF INVENTION

The present invention allows provision of an insulated wire that is excellent in any of heat resistance, electric characteristics and adhesion. The insulated wire of the present invention has the above-described excellent characteristics and therefore can be also used for miniaturized or high-performance electric equipment.

Further, the present invention allows provision of a coil and electric equipment having the above-described insulated wire.

The above-described and other features and advantages of the present invention will appear more fully from the following description, appropriately with reference to the accompanying drawing.

MODE FOR CARRYING OUT THE INVENTION

<<Insulated Wire>>

Figure 1:
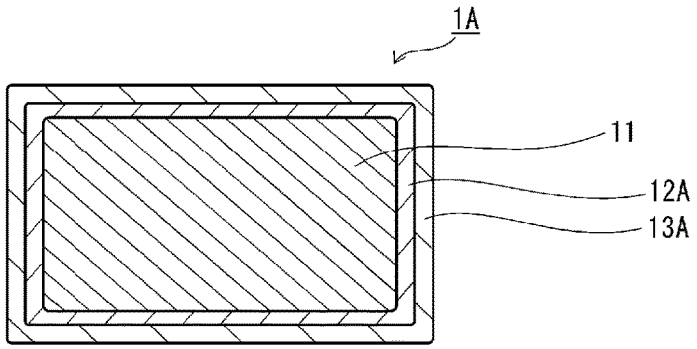
FIG. 1 is a schematic cross-sectional view showing a preferred embodiment of the insulated wire of the present invention.

The insulated wire of the present invention has a thermosetting resin layer and a thermoplastic resin layer, in this order, on the outer periphery of a conductor. The total thickness of the thermosetting resin layer and the thermoplastic resin layer is 100 μm or more and 250 μm or less. Further, in the insulated wire of the present invention, the following degree of orientation of a thermoplastic resin contained in the thermoplastic resin layer is 20% or more and 90% or less. The above-described total thickness and degree of orientation are described in detail later.

In the present invention, the thermosetting resin layer may be provided directly on the outer periphery of the above-described conductor, or may be provided through an insulating layer described later (that is, an insulating layer may lies between the above-described conductor and the thermosetting resin layer).

Further, the thermosetting resin layer, the thermoplastic resin layer and the insulating layer each may be a single layer or may be composed of multiple layers including 2 or more layers.

Hereinafter, preferred embodiments of the insulated wire according to the present invention are described with reference to drawings. However, the present invention is not limited to the following embodiments, except what is defined in the present invention. The embodiment shown in each drawing is a schematic view for facilitating understanding of the present invention, and sometimes a size and a thickness, or a relative magnitude relation and the like of each member can be changed for convenience of explanation, and therefore they do not indicate the actual relationship as it is. Further, the present invention is not limited to the external form and the shape shown in the drawings, except what is defined in the present invention.

The preferred insulated wire 1A of the present invention whose cross-sectional view is shown in FIG. 1 has a conductor 11, a thermosetting resin layer 12A provided on the outer periphery of the conductor 11, and a thermoplastic resin layer 13A provided on the outer periphery of the thermosetting resin layer 12A. The thermosetting resin layer 12A is composed of a single layer, and the thermoplastic resin layer 13A is composed of a single layer. The total thickness of the thermosetting resin layer 12A and the thermoplastic resin layer 13A is 100 μm or more and 250 μm or less. The degree of orientation in the thermoplastic resin layer 13A is 20% or more and 90% or less.

Figure 2:
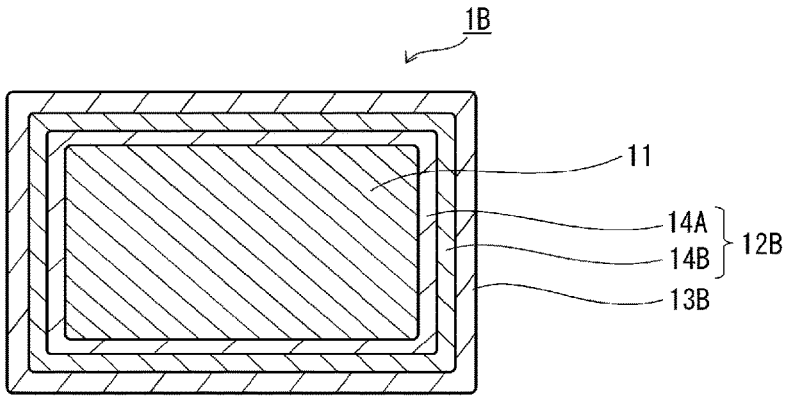
FIG. 2 is a schematic cross-sectional view showing another preferred embodiment of the insulated wire of the present invention.

The preferred insulated wire 1B of the present invention whose cross-sectional view is shown in FIG. 2 has the same configuration as the insulated wire 1A, except that the number of the layers which constitute the thermosetting resin layer is different from the insulated wire 1A. That is, the insulated wire 18 has a conductor 11, a thermosetting resin layer 12B provided on the outer periphery of the conductor 11, a thermoplastic resin layer 13B provided on the outer periphery of the thermosetting resin layer 12B. This thermosetting resin layer 128 is composed of 2 layers consisting of an inner thermosetting resin layer 14A and an outer thermosetting resin layer 148 provided in the order from the side of conductor 11.

Figure 3:
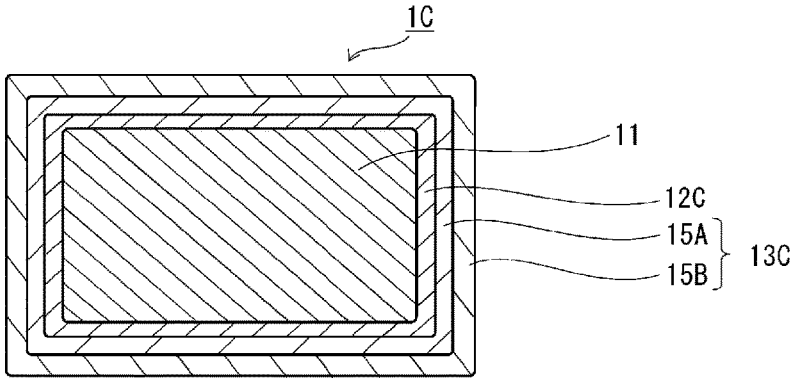
FIG. 3 is a schematic cross-sectional view showing still another preferred embodiment of the insulated wire of the present invention.

The preferred insulated wire 1C of the present invention whose cross-sectional view is shown in FIG. 3 has the same configuration as the insulated wire 1A, except that the number of the layers which constitute the thermoplastic resin layer is different from the insulated wire 1A. That is, the insulated wire 1C has a conductor 11, a thermosetting resin layer 12C provided on the outer periphery of the conductor 11, a thermoplastic resin layer 13C provided on the outer periphery of the thermosetting resin layer 12C. This thermoplastic resin layer 13C is composed of 2 layers consisting of an inner thermoplastic resin layer 15A and an outer thermoplastic resin layer 15B provided in the order from the side of thermosetting resin layer 12C.

Figure 4:
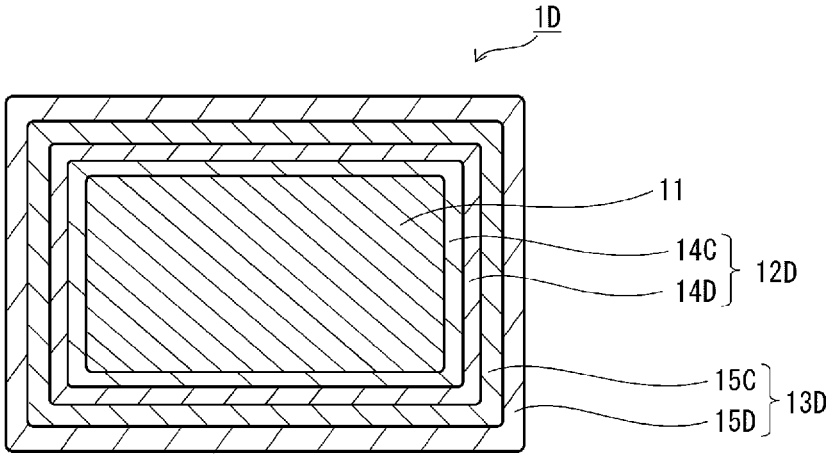
FIG. 4 is a schematic cross-sectional view showing still further preferred embodiment of the insulated wire of the present invention.
Figure 5:
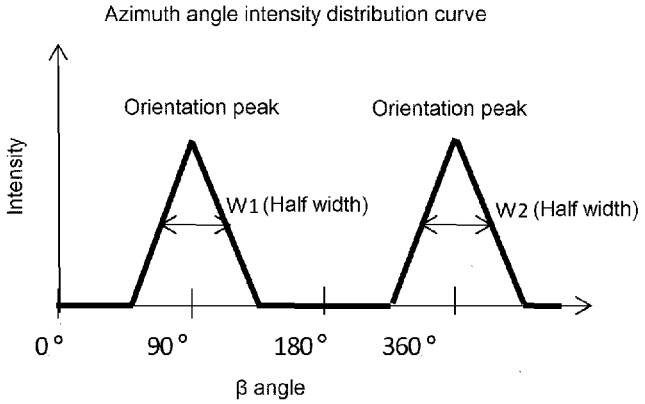
FIG. 5 is an explanatory drawing of the azimuth angle intensity distribution curve for obtaining the degree of orientation.

The preferred insulated wire 1D of the present invention whose cross-sectional view is shown in FIG. 4 has the same configuration as the insulated wire 1A, except that the number of the layers which constitute the thermosetting resin layer and the thermoplastic resin layer is different from the insulated wire 1A. That is, the insulated wire 1D has a conductor 11, a thermosetting resin layer 12D provided on the outer periphery of the conductor 11, a thermoplastic resin layer 13D provided on the outer periphery of the thermosetting resin layer 12D. The thermosetting resin layer 12D is composed of 2 layers consisting of an inner thermosetting resin layer 14C and an outer thermosetting resin layer 14D provided in the order from the side of conductor 11, and the thermoplastic resin layer 13D is composed of 2 layers consisting of an inner thermoplastic resin layer 15C and an outer thermoplastic resin layer 15D provided in the order from the side of thermosetting resin layer 12D.

FIGS. 1 to 4 each show insulated wires 1A to 1D each having a rectangular outline shape of the cross section perpendicular to the axis. However, in the present invention, the outline shape of the cross section of each insulated wire may be also changed to a circle.

In the present invention, although it is not shown, in the insulated wires 1A to 1D, an insulating layer may be also provided between the conductor 11 and the thermosetting resin layer.

<Conductor>

As the conductor for use in the present invention, ordinary ones used in the insulated wire may be widely used. For example, a metal conductor such as a copper wire and an aluminum wire can be used. A conductor of low oxygen copper having an oxygen content of 30 ppm or less is preferred, and a conductor of low oxygen copper having an oxygen content of 20 ppm or less or a conductor of oxygen-free copper is more preferred. If the oxygen content is 30 ppm or less, in a case of melting a conductor by heat in order to weld the conductor, void generation at the welded portion due to the containing oxygen is suppressed and deterioration of electric resistance at the welded portion can be prevented and also strength of the welded portion can be held.

The cross-sectional shape of the conductor is not particularly limited and examples thereof include a circle, a rectangle (flat angle shape) and the like. In particular, the cross-sectional shape is preferably a rectangle. In the present invention, the rectangle includes not only an oblong, but also a square. The conductor having a flat angle shape allows enforcement of the space factor to the slot of the stator core when wound, compared to a circular conductor.

From the viewpoint of suppressing a partial discharge from the corner, the flat rectangular conductor is preferably a conductor having a shape with chamfering (curvature radius r) at the four corners as shown in FIGS. 1 to 4. The curvature radius r is preferably 0.6 mm or less, and more preferably from 0.2 to 0.4 mm.

The size of the conductor is not particularly limited. However, in a case of a fiat rectangular conductor, in terms of the cross-sectional shape of rectangle, its width (long side) is preferably from 1.0 to 5.0 mm, and more preferably from 1.4 to 4.0 mm, and the thickness (short side) is preferably from 0.4 to 3.0 mm, and more preferably from 0.5 to 2.5 mm. The ratio (width: thickness) of a width (long side) and a thickness (short side) in length is preferably from 1:1: to 4:1. The long side means a pair of sides facing each other or each side, while the short side means a pair of other sides facing each other or each side. On the other hand, in a case of a circular cross-sectional shape, its diameter is preferably from 0.8 to 4.5 mm, and more preferably from 1.2 to 4.0 mm.

<Thermosetting Resin Layer>

The insulated wire of the present invention has a thermosetting resin layer on the outer periphery of a conductor.

The thermosetting resin layer corresponds to an enamel (resin) layer. Hereinafter, the conductor on which an enamel layer has been formed is sometimes called as an enamel wire.

The thermosetting resin layer is formed by containing a thermosetting resin and if needed, a variety of additives.

The above-described thermosetting resin is not particularly limited, as long as it is a thermosetting resin that is ordinarily used for electric wires or winding wires. Examples thereof include polyamideimide (PAI). polyimide (PI), polyester (PEst), polyurethane, polybenzimidazole, polyester imide (PEsI), a melamine resin, an epoxy resin and the like. In particular, from the viewpoint of solvent resistance, at least one thermosetting resin selected from the group consisting of polyamideimide, polyimide and polyester imide is preferable, and polyamideimide or polyimide is more preferable.

The thermosetting resin contained in the thermosetting resin layer may be one kind or two or more kinds.

The polyamideimide, when compared to the other resins, has a lower thermal conductivity and a higher dielectric breakdown voltage, and a bake-setting can be conducted. The polyamideimide is not particularly limited and includes the following commercial items and those obtained by an ordinary method. Examples thereof include a product obtained by directly reacting a tricarbonic anhydride and a diisocyanate compound in a polar solvent, and a product obtained by previously reacting a tricarbonic anhydride and a diamine compound in a polar solvent thereby to introduce an imide bond to a reactant, and then amidating the reactant with a diisocyanate compound.

The polyimide is not particularly limited, but use may be made of: any of usual polyimide resins, such as a whole aromatic polyimide and a thermosetting aromatic polyimide. Alternatively, use may be made of the following commercial items, and polyimides obtained by a usual method in which an aromatic tetracarboxylic dianhydride and an aromatic diamine compound are reacted in a polar solvent to obtain a polyamide acid solution, and then the obtained polyamide acid solution is subjected to imidization by a thermal treatment at the time of baking.

The polyester may be any polymer having an ester bond in the molecule, and having a thermosetting property. H-type polyesters (HPE) are preferred. Examples of such H-type polyesters include the following commercial items and in addition to these items, for example, aromatic polyesters modified by adding thereto a phenol resin or the like, whereby they exhibits H-type of heat resistance class.

The polyesterimide is not particularly limited, as long as it is a polymer having an ester bond and an imide bond in the molecule, and it is thermosetting. Examples thereof include the following commercial items and those obtained by ordinary methods. For example, it is also possible to use a product obtained by forming an imide bond from a tricarboxylic acid anhydride and an amine compound, and forming an ester bond from an alcohol and a carboxylic acid or an alkyl ester thereof, and making a free acidic group or anhydride group of the imide bond join in the ester formation reaction. As such a polyesterimide, for example, it is also possible to use a product obtained by reacting a tricarboxylic acid anhydride, a dicarboxylic acid compound or its alkyl ester, an alcohol compound, and a diamine compound, in accordance with a known method.

As a thermosetting resin, commercial items may be used. Examples of the commercial items of polyimide include U imide (trade name, manufactured by UNITIKA Ltd.), U-Varnish (trade name, manufactured by UBE Industries Ltd.) and the like. Examples of the commercial items of polyamideimide include HI406, HCI series (each trade name, manufactured by Hitachi Chemical Co., Ltd.) and the like. Examples of the commercial items of H-type polyester include ISONEL 200 (trade name, manufactured by Schenectady International Corporation). Examples of the commercial items of polyester imide include Neoheat 8600A (trade name, manufactured by Totoku Toryo Co., Ltd.), Various additives are not particularly limited, as long as they are additives ordinarily used for thermosetting resin layers of electric wires or winding wires. Examples thereof include those described below. The content of the additives is not particularly limited. However, 5 parts by mass or less is preferred and 2 parts by mass or less is more preferred, with respect to 100 parts by mass of the thermosetting resin.

The thermosetting resin layer may be composed of multilayers as mentioned above. However, the thermosetting resin layer is preferably composed of a single layer or two layers.

When the thermosetting resin layer is composed of multilayers, the thermosetting resins that are contained with maximum content in each layer are preferably different from each other. For example, when the thermosetting resin layer is composed of two layers, examples of preferable combinations of the thermosetting resins contained with the maximum content include a combination of polyamideimide and polyester imide and a combination of polyimide and polyamideimide, each described from the conductor side toward the side of the following thermoplastic resin layer.

The thickness of the thermosetting resin layer is not particularly limited, as long as the total thickness of the thermosetting resin layer and the thermoplastic resin layer is within the range described below. The thickness of the thermosetting resin layer is preferably from 15 to 120 μm, and more preferably from 40 to 100 μm. The upper limit of the thickness of the thermosetting resin layer may be also set, for example, to 90 μm in view of the total thickness described below. When the thermosetting resin layer is composed of multilayers, the total thickness of each layer may be within the preferable range of the thickness of the above-described thermosetting resin layer.

<Thermoplastic Resin Layer>

The insulated wire of the present invention has a thermoplastic resin layer on the outer periphery of the thermosetting resin layer.

The thermoplastic resin layer is formed by containing a thermoplastic resin and if needed, a variety of additives.

The above-described thermoplastic resin is not particularly limited, as long as it is a thermoplastic resin that is ordinarily used for electric wires or winding wires. Examples thereof include: commodity engineering plastics, such as polyamide (PA) (nylon), polyacetal (POM), polycarbonate (PC), syndiotactic polystyrene resin (SPS), polybutylene terephthalate (PBT), polyethylene terephthalate (PET), polyethylene naphthalate (PEN), and ultrahigh molecular weight polyethylene; and, in addition, super engineering plastics, such as polysulfone (PSF), polyphenylene sulfide (PPS), polyether ketone (PEK), polyarylether ketone (PAEK), tetrafluoroethylene/ethylene copolymer (ETFE), polyether ether ketone (PEEK) (including a modified PEEK), polyether ketone ketone (PEKK), tetrafluoroethylene/perfluoalkyl vinyl ether copolymer (PFA), polytetrafluoroethylene (PTFE), thermoplastic polyimide (TPI), thermoplastic polyamideimide, and liquid crystal polyester; and further polymer alloy composed of polyethylene terephthalate (PET) or polyethylene naphthalate (PEN) as a base resin, ABS/polycarbonate. NYLON 6,6, aromatic polyamide, polymer alloys containing the foregoing engineering plastics, such as polyphenylene ether/NYLON 6,6, polyphenylene ether/polystyrene, and polybutylene terephthalate/polycarbonate.

The thermoplastic resin contained in the thermoplastic resin layer may be one kind or two or more kinds.

In particular, a crystalline thermoplastic resin is preferred. Among the above-described thermoplastic resins, examples of the crystalline thermoplastic resins include: commodity engineering plastics, such as polyamide, polyacetal, polybutylene terephthalate, polyethylene terephthalate, and ultrahigh molecular weight polyethylene; syndiotactic polystyrene resin; polyphenylene sulfide; polyether ketone; polyether ether ketone; polyaryl ether ketone; polyether ketone ketone; thermoplastic polyimide; and the like.

As the thermoplastic resin, from the viewpoint of heat resistance, a thermoplastic resin having a melting point of 250° C. or more is preferred and a thermoplastic resin having a melting point of 260° C. or more and 390° C. or less is more preferred. As the foregoing resin, among the above-described ones, syndiotactic polystyrene resin, polyphenylene sulfide (PPS), polyaryl ether ketone, polyether ether ketone (PEEK), polyether ketone ketone, polyamide (in particular NYLON 6,6), polyether ketone, and thermoplastic polyimide are preferred, and at least one thermoplastic resin selected from PPS, PEEK and thermoplastic polyimide is more preferred.

The thermoplastic resin may be used selecting a proper resin from the above-described ones depending on heat resistance or mechanical characteristics and the like.

As the thermoplastic resin, from the viewpoint of the mechanical characteristics of the resin, at least one thermoplastic resin selected from the group consisting of polyether ether ketone, thermoplastic polyimide, polyphenylene sulfide and polyethylene terephthalate is preferred, and at least one thermoplastic resin selected from the group consisting of polyether ether ketone, thermoplastic polyimide and polyphenylene sulfide is more preferred.

As the thermoplastic resin, from the viewpoint of heat resistance and mechanical characteristics, and further solvent resistance, at least one thermoplastic resin that is selected from the group consisting of polyether ether ketone, thermoplastic polyimide and polyphenylene sulfide and that has a melting point of 260° C. or more and 390° C. or less is more preferred.

In the present invention, the modified PEEK is not particularly limited, as long as it is obtained by modifying PEEK, and the modified PEEK includes a chemically modified PEEK, a polymer alloyed (polymer blended) with PEEK and the like. Examples thereof include a PPS-, PES-, PPSU- or PEI-alloyed PEEK.

As the thermoplastic resin, commercial items may be used. Examples of PEEK include commercial items such as KetaSpire KT-820 (trade name, manufactured by Solvay Specialty Polymers) and PEEK 450G (trade name, manufactured by Victrex Japan). Examples of modified PEEK include commercial items such as AvaSpire AV-650 (trade name, manufactured by Solvay Specialty Polymers). Examples of TPI include commercial items such as AURUM PL450C (trade name, manufactured by Mitsui Chemicals Inc.). Examples of PPS include commercial items such as FORTRON 0220 A9 (trade name, manufactured by Polyplastics Co., Ltd.) and PPS FZ-2100 (trade name, manufactured by DIC Corporation).

Examples of the commercial items of the modified PEEK include AvaSpire AV-621, AV-630, AV-651, AV-722, AV-848 and the like manufactured by Solvay Specialty Polymers, in addition to the above, The various additives are not particularly limited, as long as each of them is an additive that is ordinarily used for electric wires or winding wires. For example, those described below may be used. The content of the additives is not particularly limited. However, the content is preferably 5 parts by weight or less, and more preferably 3 parts by weight or less, with respect to 100 parts by weight of the thermoplastic resin.

The thermoplastic resin layer may be composed of multilayers as mentioned above. However, the thermoplastic resin layer is preferably composed of a single layer or two layers.

When the thermoplastic resin layer is composed of multilayers, the thermoplastic resins that are contained with maximum content in each layer are preferably different from each other. For example, when the thermoplastic resin layer is composed of two layers, examples of preferable combinations of the thermoplastic resins contained with the maximum content include a combination of a modified PEEK and PEEK and a combination of thermoplastic polyimide and PEEK, each described from the thermosetting resin layer side toward the outer side.

The thickness of the thermoplastic resin layer is not particularly limited, as long as the total thickness of the thermosetting resin layer and the thermoplastic resin layer is within the range described below. The thickness of the thermoplastic resin layer is preferably from 15 to 100 μm, and more preferably from 30 to 70 μm. from the viewpoint of processability. When the thermoplastic resin layer is composed of multilayers, the total thickness of each layer may be within the above-described range.

The degree of orientation of a thermoplastic resin contained in the thermoplastic resin layer is from 20% to 90%. Herein, when the thermoplastic resin layer contains more than 1 kind of thermoplastic resins, the degree of orientation thereof indicates a degree of orientation of the thermoplastic resin having the largest volume ratio.

If the above-described degree of orientation is less than 20%, there is a case where a desired heat resistance cannot be imparted to the insulated wire. The upper limit of the degree of orientation is not particularly limited. However, considering actual manufacturability, the upper limit is 90%. The degree of orientation is preferably from 50 to 85%, and more preferably from 60 to 80%. If the above-described degree of orientation is from 50 to 85%, an insulated wire showing more excellent heat resistance can be obtained. Because the thermoplastic resin is oriented with the degree of orientation of from 20% to 90%. a progress of thermal decomposition and thermal deterioration of the resin is suppressed, even when exposed to heat for a long period of time. Therefore, compared to the case where the thermoplastic resin is not oriented, despite the insulated wire containing the same kind of thermoplastic resin, initial insulation properties of the insulated wire can be maintained even when exposed under a high temperature atmosphere of for example, 230° C. for a long period of time.

As the thermoplastic resin, its orientation direction (direction of extension of the molecular chain) is not particularly limited, as long as the thermoplastic resin is oriented with the degree of orientation in the above-described range. For example, a wiring (axis) direction of the electric wire is preferred.

The above-described degree of orientation can be obtained, in accordance with JIS K 0131-1996 General rules for X-ray diffraction analysis, item 15 "Evaluation of orientation", "A method using a fiber specimen stage", by, after obtaining a graph of X-ray intensity against a rotation angle, determining the degree of orientation on a basis of the curve. However, because a two-dimensional detector is used in the measurement, there is no need to actually rotate the specimen, and the graph of X-ray intensity against a rotation angle can be obtained from a two-dimensional profile which is output from the two-dimensional detector. The degree of orientation H (%) can be calculated from the following formula using a half width of the orientation peak obtained using this graph.

In this case, because in general, a horizontal axis of the graph is not called as a rotation angle, but an azimuth angle, hereinafter the graph of X-ray intensity against a rotation angle is called as an azimuth angle intensity distribution curve.

Specifically, the degree of orientation can be confirmed by the following method.

1. Test Specimen

A thermoplastic resin layer is collected from the insulated wire to prepare a test specimen.

2. Obtaining a Two-dimensional Profile

As the X-ray diffractometer, D8 DISCOVER (a measuring device integrated from X-ray sources to a goniometer) manufactured by Bruker Corporation is used and a two-dimensional detector (VANTEC 500 manufactured by Bruker Corporation) is used as a detector.

The collected test specimen is placed in the X-ray diffractometer so that the longitudinal direction of the electric wire becomes the vertical direction and X-rays are vertically incident on the thickness direction of the thermoplastic resin layer. Next, X-ray is irradiated to the thus-placed test specimen to transmit it, thereby to obtain a two-dimensional profile output from the two-dimensional detector 3. Analysis of Two-Dimensional Profile In the obtained two-dimensional profile, a diffraction ring of the resin to be analyzed for degree of orientation is selected to obtain an azimuth angle intensity distribution curve (before correction) showing a relation of X-ray intensity against a rotation angle. After correcting the azimuth angle intensity distribution curve (before correction) to subtract an azimuth angle intensity distribution curve (before correction) of each of air scattering, amorphous halo, crystal peak of the other resin, and the like, an azimuth angle intensity distribution curve of the resin to be analyzed is obtained. The azimuth angle intensity distribution curve (before correction) of amorphous halo can be obtained by the two-dimensional profile obtained in the same manner as the above, except for using an amorphous non-orientation specimen prepared by the same resin as the resin to be analyzed. Further, the azimuth angle intensity distribution curve (before correction) of air scattering can be obtained by the two-dimensional profile obtained in the same manner as the above, except for using no test specimen as a blank.

A half width of the orientation peak in the thus-obtained azimuth angle intensity distribution curve is measured and the degree of orientation H (%) is calculated from the following Formula 1.

Formula 1 Degree of orientation H (%)$=[(360-\Sigma W_n)/360]\times 100$ $W_n$: A half width of orientation peak in the azimuth angle intensity distribution curve by X-ray diffraction n: the number of orientation peak at a β angle of 0° or less and 360° or less When a plurality of thermoplastic resin layers are provided, the degree of orientation with respect to each thermoplastic resin layer is calculated as described above, using a test specimen collected from each of the thermoplastic resin layers.

In this case, it is preferred that at least the degree of orientation with respect to the outermost thermoplastic resin layer is within the above range. It is more preferred that the degree of orientation with respect to each of the thermoplastic resin layers is within the above range. In this regard, however, the degree of orientation with respect to each layer may be the same or different from each other, as long as it is within the above-described range.

Further, when the thermoplastic resin layer contains a plurality of thermoplastic resins, as the degree of orientation with respect to this type of thermoplastic resin layer, a degree of orientation of the thermoplastic resin having the largest volume ratio is calculated. Specifically, the above-described two- dimensional profile is obtained. When this two-dimensional profile is analyzed, correction is performed as follows. That Is, at first, the above-described two- dimensional profile is measure in the same manner as the case of containing one kind of thermoplastic resin. When this two-dimensional profile is analyzed, focusing on only the thermoplastic resin accounting the largest volume ratio, the peaks of thermoplastic resins other than this thermoplastic resin are processed as a base line. In this way, obtaining an azimuth angle intensity distribution curve with respect to the thermoplastic resin accounting the largest volume ratio, a degree of orientation is calculated on the basis of this curve.

(Total thickness of thermosetting resin layer and thermoplastic resin layer)

In the present invention, the total thickness of the thermosetting resin layer and the thermoplastic resin layer is 100 μm or more and 250 μm or less. If the total thickness is less than 100 μm, sometimes electric characteristics are inferior. On the other hand, if the total thickness is more than 250 μm, sometimes adhesion is inferior. In terms of compatibility at high level with electric characteristics and adhesion while maintaining high heat resistance, the total thickness is preferably set to 100 μm or more and 200 μm or less, and is more preferably set to 115 μm or more and 180 μm or less.

In the present invention, when the total thickness of the thermosetting resin layer and the thermoplastic resin layer is set to 100 μm or more and 250 μm or less, and the degree of orientation of a thermoplastics resin contained in the thermoplastic resin layer is set to 20% or more and 90% or less, heat resistance, electric characteristics and adhesion are combined at high level, whereby required characteristics of the insulated wire can be fulfilled.

<Insulating Layer>

In the present invention, an insulating layer may be provided between the conductor and the thermosetting resin layer. This insulating layer contains a resin other than the above-described thermosetting resin. As this resin, a resin that adheres to the conductor and the thermosetting resin layer, and that does not cause poor appearance even if the thermosetting resin is baked, is preferred. Examples thereof include thermoplastic resins such as polyurethane, polyester, and the like.

<Characteristics of the Insulated Wire>

The insulated wire of the present invention is excellent in heat resistance, electric characteristics and adhesion.

The insulated wire of the present invention preferably has a heat resistance such that no cracks are formed on the surface of the thermoplastic resin layer even when exposed under an environment of 230° C. for 500 hours, and more preferably has a heat resistance such that no cracks are formed on the surface of the thermoplastic resin layer even when exposed under an environment of 230° C. for 1000 hours, or furthermore for 1500 hours.

Further, in the insulated wire of the present invention, the partial discharge inception voltage is preferably 700 Vp or more, and more preferably 1000 Vp or more, in the electric characteristics test described later. The upper limit of the partial discharge inception voltage is not particularly limited. For example, the partial discharge inception voltage is preferably 2500 Vp or less.

Further, in the bending test as described below, using a preliminarily scratched insulated wire, the insulated wire of the present invention provides adhesion between a conductor and a resin layer (in this test, the thermosetting resin layer and the thermoplastic resin layer are collectively referred to as a resin layer) to the extent that delamination between the conductor and the resin layer cannot be confirmed.

<Production Method of Insulated Wire>

The insulated wire of the present invention can be produced by forming a thermosetting resin layer on the outer periphery of a conductor, and a thermoplastic resin layer on the outer periphery of the thermosetting resin layer.

In more detail, the insulated wire can be produced by sequentially or simultaneously forming the thermosetting resin layer and the thermoplastic resin layer on the outer periphery of the conductor. Further, if desired, a forming process of the above-described insulating layer may be incorporated.

The thermosetting resin layer is ordinarily formed by conducting coating and baking on the outer periphery of the conductor. Specifically, the thermosetting resin layer is preferably formed by coating and baking a varnish containing a thermosetting resin on the outer periphery of the conductor.

An ordinary method can be applied to the method of coating a varnish, without any particular limitation. Examples thereof include a method of using a varnish-coating die having a similar shape to the cross-sectional shape of the conductor, and when the cross-sectional shape of the conductor is rectangular, a method of using a die that is called as "Universal die" formed in the grid shape.

The baking after varnish-coating can be performed by an ordinary method. For example, the baking can be performed in a baking furnace. The baking conditions in this case depend on the shape and the like of the furnace to be used and cannot be unambiguously decided. In the case where the furnace is a natural convection vertical furnace of about 8 m, for example, the conditions are at the furnace temperature of 400 to 650° C. and the transition time of from 10to 90 sec.

The coating and baking of the varnish can be done once. However, ordinarily it is preferable to repeat this process multiple times. When this process is repeated multiple times, it may be performed by the same baking conditions, or different baking conditions.

In this way, the thermosetting resin layer can be formed.

When the insulated wire of the present invention is composed of multiple layers including 2 or more thermosetting resin layers, the multiple thermosetting resin layers each may be formed by the above-described process.

In the above-described varnish, various kinds of additives may be contained to the extent that they do not affect the characteristics of each layer. The various kinds of additives are not particularly limited. Examples thereof include a ceil nucleating agent, an antioxidant, an antistatic agent, an ultraviolet Inhibitor, a light stabilizer, a fluorescent brightening agent, a pigment, a dye, a compatibilizing agent, a lubricating agent, a reinforcing agent, a flame retardant, a crosslinking agent, a crosslinking aid, a plasticizer, a thickener, a thinning agent, an elastomer, and the like.

It is preferred that the varnish contains an organic solvent or the like in order to varnish the thermosetting resin. Examples of the organic solvent include; amide-based solvents, such as N-methyl-2-pyrrolidone (NMP), N,N-dimethylacetamide (DMAC), and N,N-dimethylformamide (DMF); urea-based solvents, such as N,N-dimethylethyleneurea, N,N-dimethylpropyleneurea, and tetramethylurea; lactone-based solvents, such as γ-butyrolactone and γ-caprolactone; carbonate-based solvents, such as propylene carbonate; ketone-based solvents, such as methyl ethyl ketone, methyl isobutyl ketone, and cyclohexanone; ester-based solvents, such as ethyl acetate, n-butyl acetate, butyl cellosolve acetate, butyl carbitol acetate, ethyl cellosolve acetate, and ethyl carbitol acetate; glyme-based solvents, such as diglyme, triglyme, and tetraglyme; hydrocarbon-based solvents, such as toluene, xylene, and cyclohexane; phenol-based solvents, such as cresol, phenol, and halogenated phenol; sulfone-based solvents, such as sulfolane; and dimethylsulfoxide (DMSO).

As the organic solvent or the like, only one kind may be used alone, or two or more kinds may be used in combination.

The thermoplastic resin layer is ordinarily formed by extrusion coating. Specifically, the thermoplastic resin layer is preferably formed by heating and melting a thermoplastic resin and then extruding and coating the melted thermoplastic resin on the outer periphery of the thermosetting resin layer. Examples thereof include a method of extruding a thermoplastic resin on the outer periphery of the thermosetting resin layer at a temperature equal to or more than the melting temperature of the thermoplastic resin by using an extrusion die having an opening similar to or approximately similar to the cross-sectional shape of the conductor.

In the present invention, a method of setting the degree of orientation of the thermoplastic resin is not particularly limited. As one example, the following methods or conditions are included. For example, there are conditions (temperature conditions) in extrusion coating, a thickness of the thermoplastic resin layer, a linear speed at the time of the electric wire production, and the like.

More specifically, the method includes a method of preheating an enamel wire at the temperature lower than the extrusion temperature (screw temperature) of the thermoplastic resin. When the enamel wire is preheated in this way, the degree of orientation fends to be improved. The preheating temperature of the enamel wire cannot be unambiguously decided due to the kind of the thermoplastic resin to be used, the thickness of the thermoplastic resin layer to be formed, and the like. In a case of forming the thermoplastic resin layer fulfilling the total thickness of the above-described range, for example, as the preheating temperature, a temperature lower by about 120 to about 280° C. than the extrusion temperature of the thermoplastic resin at the time of extruding and coating, is preferable. A temperature lower by 150 to 280° C. is more preferable. As a specific preheating temperature, for example, the lower limit is preferably 80° C. or more and the upper limit is preferably 200° C. or less. Depending on the kind of the thermoplastic resin, for example, the lower limit of the preheating temperature may be set to 100° C. and the upper limit may be set to 150° C., moreover to 130° C.

Further, the method includes a method of setting a die temperature to a different temperature from the extrusion temperature, using a die heater. The die temperature cannot be unconditionally determined owing to the kind of thermoplastic resin to be used, and the like. However, the die temperature can be set to the range of, for example, 220 to 300° C. In this way, by a temperature difference between the thermoplastic resin and the above-described conductor (enamel wire) or a die, and a shear force by extrusion or the like, a thermoplastic resin in the extruded thermoplastic resin can be orientated.

Further, the method includes a method of advancing a linear speed at the time of electric wire production (at the time of extrusion molding), if the linear speed at the time of wire production is increased, the degree of orientation tends to be improved.

Further, if the thermoplastic resin layer is thickened, the degree of orientation tends to decrease.

In the present invention, the above-described methods may be appropriately combined.

As a method of setting the degree of orientation, among them, the above-described method of preheating is preferable. In this case, the method of producing the insulated wire of the present invention has a process of setting the above-described enamel wire to a temperature lower by 120 to 280° C. than the extrusion temperature of a thermoplastic resin, and extruding the thermoplastic resin together with said enamel wire.

The extrusion conditions are not particularly limited, except for the above-described points, and may be appropriately set depending on the resin used.

In the insulated wire of the present invention, when the thermoplastic resin layer is composed of multiple layers of 2 or more layers, the multiple-resin layers may be each formed by the above-described process. Further, the multiple resin layers may be formed at the same time using a co-extruder When the insulated wire of the present Invention has an insulating layer, the insulating layer may be formed by coating a resin on the outer periphery of the conductor.

[Coil and Electric Equipment]

The insulated wire of the present invention is applicable, as a coil, to a field which requires electrical properties (resistance to voltage) and heat resistance, such as various kinds of electric equipment. For example, the insulated wire of the present invention can be used for a motor, a transformer and the like, and can compose high-performance electric equipment. In particular, the insulated wire is preferably used as a winding wire for a driving motor of HV (Hybrid Vehicle) and EV (Electric Vehicle). As descried above, according to the present invention, it is possible to provide electric equipment, in particular a driving motor of HV and EV, using the insulated wire of the present invention as a coil. Meanwhile, when the insulated wire of the present invention is used for a motor coil, it may be also called as an insulated wire for motor coil, in particular, a coil formed by processing the insulated wire of the present invention having the above-described excellent characteristics allows further miniaturization and high performance of the electric equipment. Accordingly, the insulated wire of the present invention is preferably used as a winding wire for a driving motor of HV and EV which is remarkable in miniaturization and high performance in recent years.

The coil of the present invention is not particularly limited, as long as it has a form suitable for various kinds of electric equipment, and examples thereof include items formed by coil processing the insulated wire of the present invention, and items formed by electrically connecting prescribed parts after bending the insulated wire of the present invention.

The coils formed by coil processing the insulated wire of the present invention are not particularly limited, and examples thereof include a coil formed by spirally winding around a long insulated wire. In these coils, the number of winding wire or the like of the insulated wire Is not particularly limited. Ordinarily, in winding around the insulated wire, an iron core or the like is used.

Example of the coils formed by electrically connecting prescribed parts after bending the insulated wire of the present invention include coils used in stators for rotating electrical machines or the like. Examples of these coils include a coil 33 (see FIG. 6) prepared by, as shown in FIG. 7, cutting the insulated wire of the present invention in a prescribed length, and then bending them in the U-shaped form or the like, thereby preparing a plurality of wire segments 34, and then alternately connecting two open ends (terminals) 34*a* in the U-shaped form or the like of each wire segment 34.

Figure 6:
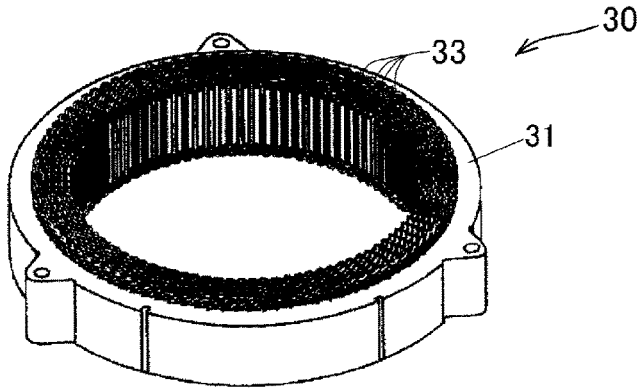
FIG. 6 is a schematic perspective view showing a preferred embodiment of the stator used in the electric equipment of the present invention.
Figure 7:
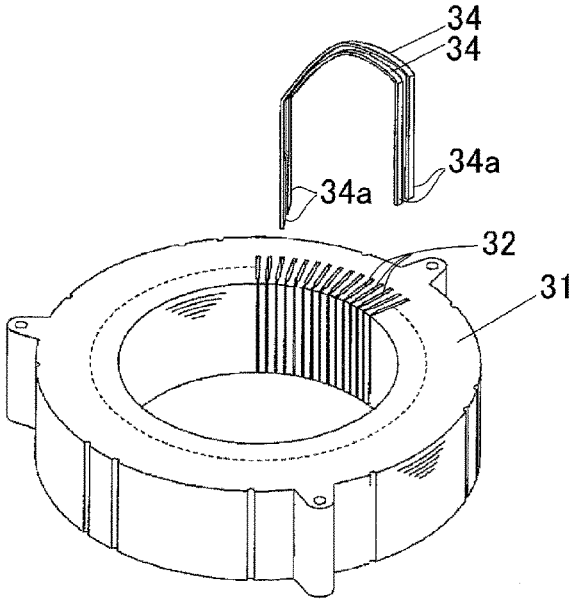
FIG. 7 is a schematic exploded perspective view showing a preferred embodiment of the stator used in the electric equipment of the present invention.

The electric equipment formed by using the coil of the present invention is not particularly limited, and examples of one preferable embodiment of such electric equipment include a rotating electric machine equipped with a stator 30 shown in FIG. 6 (in particular, driving motors of HV and EV). This rotating electric machine can be made in the same constitution as the conventional one, except for equipment of the stator 30.

The stator 30 can be made in the same constitution as the conventional one, except that its wire segment 34 is formed by the insulated wire of the present invention. Specifically, the stator 30 has a stator core 31, and a coil 33 in which, as shown in such as FIG. 7, the wire segments 34 formed of the insulated wire of the present invention are incorporated in a slot 32 of the stator core 31 and open ends 34*a* are electrically connected. Herein, the wire segment 34 may be incorporated in the slot 32 with one segment. However, it is preferable that as shown in FIG. 7, two segments are incorporated in pairs. In this stator 30, the coil 33 formed by alternately connecting the open ends 34*a* that are two ends of the wire segments 34 which have been bent as described above, is incorporated in the slot 32 of the stator core 31. In this time, the wire segment 34 may be incorporated in the slot 32 after connecting the open ends 34*a* thereof. Alternatively, after incorporating the wire segment 34 in the slot 32, the open ends 34*a* of the wire segment 34 may be a bent, thereby to connect them.

EXAMPLES

The present invention will be described in more detail based on examples given below, but the invention is not meant to be limited by these.

The insulated wire 1A shown in FIG. 1 was produced in Examples 1 to 10. The insulated wire 1B shown in FIG. 2 was produced in Examples 11 and 12. The insulated wire 1C shown in FIG. 3 was produced in Example 13. The insulated wire 1D shown in FIG. 4 was produced in Example 14. With respect to each of the produced insulated wires, the following characteristics were evaluated and the results were shown in Table 1.

Details of the resins or varnishes used in each Example are described later.

Example 1

As a conductor 11, a rectangular conductor (copper having an oxygen content of 15 ppm) having a rectangular cross-section (long side 3.3 mm×short side 1.8 mm, curvature radius r of chamfered edge at four corners r=0.3 mm) was used.

By coating a polyamideimide resin varnish on the outer periphery of a conductor 11 with a die having a similar shape to the cross-sectional shape of the conductor, and then passing the resultant through a 8 m-long baking furnace having an inner temperature of 450° C., at a rate at which the transit time is 15 sec., and then repeating this coating and baking processing 31 times, an enamel wire having a 100 μm-thick thermosetting resin layer composed of PAI was obtained.

Next, on the outer periphery of the obtained enamel wire, a 15 μm-thick thermoplastic resin layer 13A composed of polyetherether ketone was formed. Specifically, on the outer periphery of the enamel wire preheated at 180° C., PEEK was extruded using a die having a similar shape to the outer shape of the cross-section of the thermosetting resin layer 12A (the temperature (extrusion temperature) of the screw part was set to 380° C. and the die temperature was set to 300° C.). A difference between the extrusion temperature and the preheating temperature was shown as Temperature difference in Table 1. As the extruder, an extruder equipped with a 30 mm full flight screw (screw L/D=25, screw compression ratio=3) was used.

In this way, the insulated wire 1A provided with the thermosetting resin layer 12A and the thermoplastic resin layer 13A was obtained.

Examples 2 to 10 and Comparative Examples 1 to 3

The insulated wires of Examples 2 to 10 and Comparative Examples 1 to 3 were obtained in the same manner as Example 1, except that in the above-described Example 1, the kind of the resin varnish or resin each of which forms the thermosetting resin layer 12A and the thermoplastic resin layer 13A, the thickness of each layer, the extrusion temperature, the preheating temperature of the enamel wire, and the die temperature were changed as shown in the following table.

Herein, Comparative Example 2 is an experimental example in which a thermoplastic resin layer was formed under the conventional extrusion conditions (preheating temperature). In Comparative Example 2, the extrusion temperature of the thermoplastic resin layer was 380° C., and the preheating temperature of the enamel wire was 280° C.

Example 11

By coating a polyimide varnish on the outer periphery of the conductor 11 of Example 1 with a die having a similar shape to the cross-sectional shape of the conductor 11, and then passing the resultant through a 8 m-long baking furnace whose inner temperature was set to 450° C., at a rate at which the transit time was 15 sec., and then repeating this coating and baking processing 18 times, a 50 μm-thick thermosetting resin layer 14A composed of PI was formed.

Next, by coating a PAI varnish on the outer periphery of the thermosetting resin layer 14A with a die having a similar shape to the outer shape of the cross-section of the thermosetting resin layer 14A, and then passing the resultant through a 8 m-long baking furnace whose inner temperature was set to 450° C. at a rate at which the transit time was 15 sec., and then repeating this coating and baking processing 11 times, a 30 μm-thick thermosetting resin layer 14B composed of PAI was formed.

In this way, the enamel wire provided with a thermosetting resin layer 12B having a two-layer structure consisting of the thermosetting resin layer 14A and the thermosetting resin layer 14B was obtained.

Next, on the outer periphery of the thermosetting resin layer 14A, a 60 μm-thick thermoplastic resin layer 13B composed of PEEK was formed. Specifically, on the outer periphery of the enamel wire preheated at 180° C., PEEK was extruded using a die having a similar shape to the outer shape of the cross-section of the thermosetting resin layer 12B (the extrusion temperature and the die temperature was each set to 380° C). As the extruder, an extruder equipped with a 30 mm full flight screw (screw L/D=25, screw compression ratio=3) was used.

In this way, the insulated wire 18 provided with the thermosetting resin layer 12B having a two-layer structure and the thermoplastic resin layer 13B was obtained.

Example 12

The insulated wire 18 of Example 12 was obtained in the same manner as Example 11, except that in the above-described Example 11, the kind of the resin varnish and resin to form the thermosetting resin layer 12B and the thermoplastic resin layer 13B, the thickness of each layer, the extrusion temperature, and the preheating temperature of the enamel wire were changed as shown in the following table.

Example 13

The enamel wire provided with a thermoplastic resin layer 15A composed of a modified PEEK on the outer periphery of the thermosetting resin layer 12C was obtained in the same manner as Example 5.

Next, a 40 μm-thick thermoplastic resin layer 15B composed of PEEK was formed. Specifically, on the outer periphery of the enamel wire preheated at 180° C., PEEK was extruded using a die having a similar shape to the outer shape of the cross-section of the thermosetting resin layer 15A (the extrusion temperature was set to 380° C. and the extrusion die temperature (die temperature) was set to 280° C.). As the extruder, an extruder equipped with a 30 mm full flight screw (screw L/D=25, screw compression ratio=3) was used.

In this way, the insulated wire 1C provided with the thermosetting resin layer 12C and the thermoplastic resin layer 13C having a two-layer structure was obtained.

Example 14

The enamel wire was obtained in the same manner as Example 11, except that in Example 11, the thickness of the thermosetting resin layer 14D was changed as shown in the table below, by changing the number of coating and baking of the polyamideimide resin varnish. This enamel wire is provided with the thermosetting resin layer 12D having a two-layer structure.

The thermoplastic resin layer 15C composed of TPI was formed in the same manner as Example 6 on the outer periphery of the obtained enamel wire, except that the thickness of the thermoplastic resin layer was changed to 30 μm. Next, on the outer periphery of the thermoplastic resin layer 15C, the thermoplastic resin layer 15D composed of PEEK was formed in the same manner as Example 13.

In this way, the insulated wire 1D provided with the thermosetting resin layer 12D having a two-layer structure and the thermoplastic resin layer 13D having a two-layer structure was obtained.

With respect to each insulated wire, the following measurements and evaluations were conducted.

The results obtained are summarized and shown in the following Table 1.

[Degree of Orientation of Thermoplastic Resin Layer]

The degree of orientation of the thermoplastic resin layer in each insulated wire was calculated by the above-described method.

The conditions at the time of obtaining a two-dimensional profile in Example 1 were as follows.

Temperature: 25±5° C.

General condition (neither vacuum state nor helium gas-filled state, but in a normal air)

X-ray source (Cu tube) power 40 kV 40 mA (1.6 kW)

Slit diameter and collimator diameter 0.5 mmφ

Sample thickness 15 μm

Distance between specimen and detector 100 mm

Measuring time 20 minutes

[Bending Workability Test (Adhesion Test)]

Adhesion between a conductor and a resin layer of the insulated wire was evaluated by the following bending workability test.

A 300 mm-long straight test specimen was cut-off from each manufactured insulated wires. A scratch (incision) of about 5 μm in depth and 2 μm in length was put on a central part of the thermosetting resin layers at the edge surface of this straight test specimen, using a dedicated jig, in both the longitudinal direction and the vertical direction (in this instance, the thermosetting resin layer and the conductor were adhered to each other and were not delaminated therefrom). Herein, the edge surface means a surface formed by a short side (thickness, the side along the vertical direction in FIGS. 1 to 4) in the cross-sectional shape of the rectangle-shaped insulated wire continuously aligning in the axis direction. Accordingly, the above-described scratch is provided at either one of right- or left-side in the drawing of the insulated wire shown in FIGS. 1 to 4.

The straight test specimen was bent, with this scratch at the top, centering on the iron core having a diameter of 1.0 mm at 180° (in a U-shape), and this state was kept for 5 minutes. Progression of deamination between the conductor and the resin layer occurred near the top of the straight test specimen was visually observed.

In this test, when any scratch formed in the thermoplastic resin layer did not spread to the thermosetting resin layer, and the thermosetting resin layer was not delaminated from the conductor, this case was rated as "A" When at least one scratch formed on the thermosetting resin layer did spread, and the entire resin layer was delaminated from the conductor, this case was rated as "C" .

[Electric Characteristics (Partial Discharge Inception Voltage (PDIV)) Test]

In the measurement of the partial discharge inception voltage of each insulated wire produced, a partial discharge tester [KPD2050] (trade name, manufactured by Kikusui Electronics Corp.) was used.

A test specimen in which flat surfaces of two lengths of the insulated wire were closely attached to each other over the length of 150 mm so that there is no gap was prepared Electrodes were connected between the two conductors of this test specimen and were continuously boosted while applying an alternating-current voltage of 50 Hz at a temperature of 25° C., and a voltage at the time when a discharge of 10 pC occurred was red at a peak voltage (Vp), Herein, the term "flat surface" means a surface formed by a long side (side in the horizontal direction in FIGS. 1 to 4) in the cross-sectional shape of the rectangle-shaped insulated wire continuously aligning in the axis direction. Accordingly, the above-described test specimen is in a state that another insulated wire 1 has been overlapped on the upper or lower side of the insulated wire 1 shown in FIG. 1.

When the peak voltage was 1000 (Vp) or more, this case was rated as "A". When the peak voltage was 700 (Vp) or more and less than 1000 (Vp), this case was rated as "B". When the peak voltage was less than 700 (Vp), this case was rated as "C". In this test, evaluation "B" or more is an acceptable level. Evaluation "A" is an especially excellent level.

[Heat Resistance Test]

Heat resistance of each insulated wire was evaluated by the following heat aging test. Specifically, after leaving to stand each of 1%-elongated linear insulated wires in a thermostat of 230° C. for 500 hrs, 1000 hrs and 1500 hrs, occurrence of cracks at the outermost layer surface was visually confirmed.

Evaluation was conducted by the time (still standing time) when cracks occurred in the outermost layer surface of the thermoplastic resin layer, based on the following criteria. When cracks were not confirmed in the outermost layer surface, even if it was left to stand for 1500 hrs. this case was rated as "AA". When cracks were not confirmed in the outermost layer surface, even if it was left to stand for 1000 hrs (when it was left to stand for 1500 hrs, cracks were confirmed), this case was rated as "A". When cracks were not confirmed in the outermost layer surface, even if it was left to stand for 500 hrs (when it was left to stand for 1000 hrs, cracks were confirmed), this case was rated as "B". When cracks were confirmed in the outermost layer surface by leaving to stand it for 500 hrs, this case was rated as "C", as being rejected. In this test, evaluation "B" or more is an acceptable level. Evaluation "AA" is an especially excellent level.

The details of the resin or resin varnish used in each Example were as follows.

PAI resin varnish: Polyamideimide (trade name: HI406, varnish manufactured by Hitachi Chemical Co., Ltd.)

PI resin varnish: Polyimide (trade name: U imide AR, varnish manufactured by UNITIKA Ltd.)

PEsI resin varnish: Polyester imide (trade name: Neoheat, varnish manufactured by Totoku Toryo Co., Ltd.)

PEEK: Polyetherether ketone (trade name: 450G manufactured by Victrex Japan, melting point 343° C.)

PPS: Polyphenylene sulfide (trade name: DICPPS manufactured by DIC Corporation, melting point 280° C.)

Modified PEEK: Modified polyetherether ketone (trade name: AV-651, manufactured by Solvay Specialty Polymers Japan, melting point 345° C.)

TPI: Thermoplastic polyimide (trade name: AURUM PL450C, manufactured by Mitsui Chemicals Inc., melting point 388° C.)

PET: Polyethylene terephthalate (trade name: TR-8550, manufactured by Teijin Limited., melting point 252° C.)

TABLE 1

| | | | Example 1 | Example 2 | Example 3 | Example 4 | Example 5 | Example 6 |
|---|---|---|---|---|---|---|---|---|
| Thermosetting resin layer | Inner | Resin | PAI | PAI | PI | PAI | PAI | PAI |
| | | Thickness (μm) | 100 | 40 | 50 | 60 | 40 | 40 |
| | Outer | Resin | | | | | | |
| | | Thickness (μm) | | | | | | |
| Thermoplastic resin layer | Inner | Resin | PEEK | PEEK | PEEK | PPS | modified PEEK | TPI |
| | | Thickness (μm) | 15 | 60 | 70 | 40 | 60 | 60 |
| | | Extrusion temperature (° C.) | 380 | 380 | 380 | 330 | 380 | 420 |
| | | Preheating temperature (° C.) | 180 | 180 | 180 | 120 | 150 | 200 |
| | | Temperature difference (° C.) | 200 | 200 | 200 | 210 | 200 | 220 |
| | | Die temperature (° C.) | 300 | 300 | 300 | 300 | 300 | 300 |
| | | Degree of orientation (%) | 75 | 45 | 40 | 70 | 40 | 40 |
| | Outer | Resin | | | | | | |
| | | Thickness (μm) | | | | | | |
| | | Extrusion temperature (° C.) | | | | | | |
| | | Preheating temperature (° C.) | | | | | | |
| | | Temperature difference (° C.) | | | | | | |
| | | Die temperature (° C.) | | | | | | |
| | | Degree of orientation (%) | | | | | | |
| Total thickness of thermosetting resin layer and thermoplastic resin layer (μm) | | | 115 | 100 | 120 | 100 | 100 | 100 |
| Bending workability test | | | A | A | A | A | A | A |
| Electric characteristics test | | | A | A | A | A | A | A |
| Heat resistance test | | | AA | A | A | A | A | A |

| | | | Example 7 | Example 8 | Example 9 | Example 10 | Example 11 | Example 12 |
|---|---|---|---|---|---|---|---|---|
| Thermosetting resin layer | Inner | Resin | PEsI | PAI | PAI | PAI | PI | PAI |
| | | Thickness (μm) | 50 | 60 | 120 | 40 | 50 | 40 |
| | Outer | Resin | | | | | PAI | PEsI |
| | | Thickness (μm) | | | | | 30 | 30 |
| Thermoplastic resin layer | Inner | Resin | modified PEEK | PEEK | PEEK | PET | PEEK | PPS |
| | | Thickness (μm) | 70 | 100 | 130 | 60 | 60 | 40 |
| | | Extrusion temperature (° C.) | 380 | 380 | 380 | 280 | 380 | 330 |
| | | Preheating temperature (° C.) | 180 | 180 | 165 | 100 | 180 | 120 |
| | | Temperature difference (° C.) | 200 | 200 | 215 | 180 | 200 | 210 |

TABLE 1-continued

| | | | | | | | |
|---|---|---|---|---|---|---|---|
| | Die temperature (° C.) | 300 | 300 | 300 | 300 | 380 | 380 |
| | Degree of orientation (%) | 35 | 20 | 20 | 50 | 45 | 70 |
| Outer | Resin | | | | | | |
| | Thickness (μm) | | | | | | |
| | Extrusion temperature (° C.) | | | | | | |
| | Preheating temperature (° C.) | | | | | | |
| | Temperature difference (° C.) | | | | | | |
| | Die temperature (° C.) | | | | | | |
| | Degree of orientation (%) | | | | | | |
| Total thickness of thermosetting resin layer and thermoplastic resin layer (μm) | | 120 | 160 | 250 | 100 | 140 | 110 |
| Bending workability test | | A | A | A | A | A | A |
| Electric characteristics test | | A | A | A | A | A | A |
| Heat resistance test | | A | B | B | B | A | A |

| | | | Example 13 | Example 14 | Comparative example 1 | Comparative example 2 | Comparative example 3 |
|---|---|---|---|---|---|---|---|
| Thermosetting resin layer | Inner | Resin | PAI | PI | PAI | PAI | PAI |
| | | Thickness (μm) | 40 | 50 | 40 | 40 | 100 |
| | Outer | Resin | | PAI | | | |
| | | Thickness (μm) | | 40 | | | |
| Thermoplastic resin layer | Inner | Resin | modified PEEK | TPI | PEEK | PEEK | PEEK |
| | | Thickness (μm) | 60 | 30 | 50 | 80 | 180 |
| | | Extrusion temperature (° C.) | 380 | 420 | 380 | 380 | 380 |
| | | Preheating temperature (° C.) | 180 | 200 | 180 | 280 | 180 |
| | | Temperature difference (° C.) | 200 | 220 | 200 | 100 | 200 |
| | | Die temperature (° C.) | 300 | 300 | 300 | 300 | 300 |
| | | Degree of orientation (%) | 40 | 60 | 60 | 10 | 20 |
| | Outer | Resin | PEEK | PEEK | | | |
| | | Thickness (μm) | 40 | 40 | | | |
| | | Extrusion temperature (° C.) | 380 | 380 | | | |
| | | Preheating temperature (° C.) | 180 | 180 | | | |
| | | Temperature difference (° C.) | 200 | 200 | | | |
| | | Die temperature (° C.) | 280 | 280 | | | |
| | | Degree of orientation (%) | 70 | 70 | | | |
| Total thickness of thermosetting resin layer and thermoplastic resin layer (μm) | | | 140 | 160 | 90 | 120 | 280 |
| Bending workability test | | | A | A | A | A | C |
| Electric characteristics test | | | A | A | C | A | A |
| Heat resistance test | | | AA | AA | AA | C | B |

It is apparent from Table 1 that the insulated wires of Examples 1 to 14 each of which had a thermosetting resin layer and a thermoplastic resin layer having a specific degree of orientation, passed all of the bending workability test, the electric characteristics test, and the heat resistance test.

It is seen from comparison between Examples 1 to 7 and Example 10 that when the melting point of the thermoplastic resin of the thermoplastic resin layer is 260° C. or more and 390° C. or less, more excellent heat resistance is achieved.

Meanwhile, it is seen that because each of Examples 1 to 14 was excellent in adhesion (these insulated wires passed the above-described bending workability test), the thermosetting resin layer and the thermoplastic resin layer are not delaminated therefrom when inserting the insulated wire into a slot of the stator core.

The insulated wire of Comparative Example 1 did not show sufficient electric characteristics, because the total thickness of the thermosetting resin layer and the thermoplastic resin layer was thin. The insulated wire of Comparative Example 2 resulted in inferior heat resistance, because the degree of orientation of the thermoplastic resin layer was low. The insulated wire of Comparative Example 3 resulted in inferior adhesion, because the total thickness of the thermosetting resin layer and the thermoplastic resin layer was thick.

It is seen from the forgoing results that the present invention which resides in an insulated wire having the above-described layer composition and fulfilling both predetermined degree of orientation and total thickness, allows provision of an insulated wire which is excellent in bending workability, electric characteristics, and heat resistance.

Having described our invention as related to the present embodiments, it is our intention that the invention not be limited by any of the details of the description, unless otherwise specified, but rather be construed broadly within its spirit and scope as set out in the accompanying claims.

This application claims priority on Patent Application No. 2016-141817 filed in Japan on Jul. 19, 2016, which is entirely herein incorporated by reference.

REFERENCE SIGNS LIST

1A, 1B, 1C, 1D Insulated wire
11 Conductor
12A, 12B, 12C, 12D Thermosetting resin layer
13A, 13B, 13C, 13D Thermoplastic resin layer
14A, 14C Inner thermosetting resin layer
14B, 14D Outer thermosetting resin layer
15A, 15C Inner thermoplastic resin layer
15B, 15D Outer thermoplastic resin layer
30 Stator
31 Stator core
32 Slot
33 Coil
34 Wire segment
34*a* Open end

The invention claimed is:

1. An insulated wire comprising a thermosetting resin layer on the outer periphery of a conductor, and a thermoplastic resin layer on the outer periphery of the thermosetting resin layer, wherein a total thickness of the thermosetting resin layer and the thermoplastic resin layer is 100 μm or more and 250 μm or less, and a degree of orientation of a thermoplastic resin in the thermoplastic resin layer, that is calculated by the following Formula 1, is 20% or more and 90% or less;

Formula 1 Degree of orientation H (%)=$[(360-\Sigma W_n)/360]\times 100$ $W_n$: A half width of orientation peak in the azimuth angle intensity distribution curve by X-ray diffraction n: the number of orientation peak at a β angle of 0° or more and 360° or less.

2. The insulated wire described in claim 1, wherein the thermoplastic resin layer comprises at least one thermoplastic resin selected from the group consisting of a polyetheretherketone, a thermoplastic polyimide, and a polyphenylene sulfide, and a melting point of the thermoplastic resin is 260° C. or more and 390° C. or less.

3. The insulated wire described in claim 1, wherein a thickness of the thermoplastic resin layer is 15 μm or more and 100 μm or less.

4. The insulated wire described in claim 1, wherein the thermosetting resin layer comprises at least one thermosetting resin selected from the group consisting of a polyamideimide, a polyimide, and a polyesterimide.

5. A coil comprising the insulated wire described in claim 1.

6. An electric or electronic equipment formed with using the coil described in claim 5.

* * * * *